United States Patent [19]

Gunnewig

[11] 4,151,950

[45] May 1, 1979

[54] CONTINUOUSLY OPERATING CENTRIFUGAL SEPARATOR HAVING HYDRAULICALLY OPERATED VALVES

[75] Inventor: Hubert Gunnewig, Oelde, Fed. Rep. of Germany

[73] Assignee: Westfalia Separator AG, Oelde, Fed. Rep. of Germany

[21] Appl. No.: 868,105

[22] Filed: Jan. 9, 1978

[30] Foreign Application Priority Data

Jan. 17, 1977 [DE] Fed. Rep. of Germany ..... 2701624

[51] Int. Cl.[2] ..... B04B 11/02

[52] U.S. Cl. ..... 233/19 R

[58] Field of Search ..... 233/19 R, 19 A, 20 R, 233/20 A, 27, 28, 29, 46

[56] References Cited

U.S. PATENT DOCUMENTS

| | | | |
|---|---|---|---|
| 2,136,127 | 11/1938 | Fawcett | 233/20 A |
| 2,321,887 | 6/1943 | Ayres | 233/20 R |
| 2,873,910 | 2/1959 | Steinacker | 233/20 R |
| 3,145,223 | 8/1964 | Little | 233/20 R |
| 4,054,244 | 10/1977 | Paschedag | 233/20 A |
| 4,825,176 | 7/1974 | Henfort | 233/20 R |

FOREIGN PATENT DOCUMENTS

| | | | |
|---|---|---|---|
| 777153 | 6/1957 | United Kingdom | 233/20 R |

*Primary Examiner*—George H. Krizmanich

*Attorney, Agent, or Firm*—Sprung, Felfe, Horn, Lynch & Kramer

[57] ABSTRACT

Centrifugal separator having control valves 12 in the concentrated phase discharge passageway 10 for control of the concentration of solids in the concentrated phase. The control valves are hydraulically operated and have a control chamber 12*c* for the control fluid. The control fluid is clear phase obtained by communicating the control chamber 12*c* with the paring chamber 6 for the clear phase. Desirably the closing device of the valves is a resilient deformable tube membrane 12*b*.

5 Claims, 1 Drawing Figure

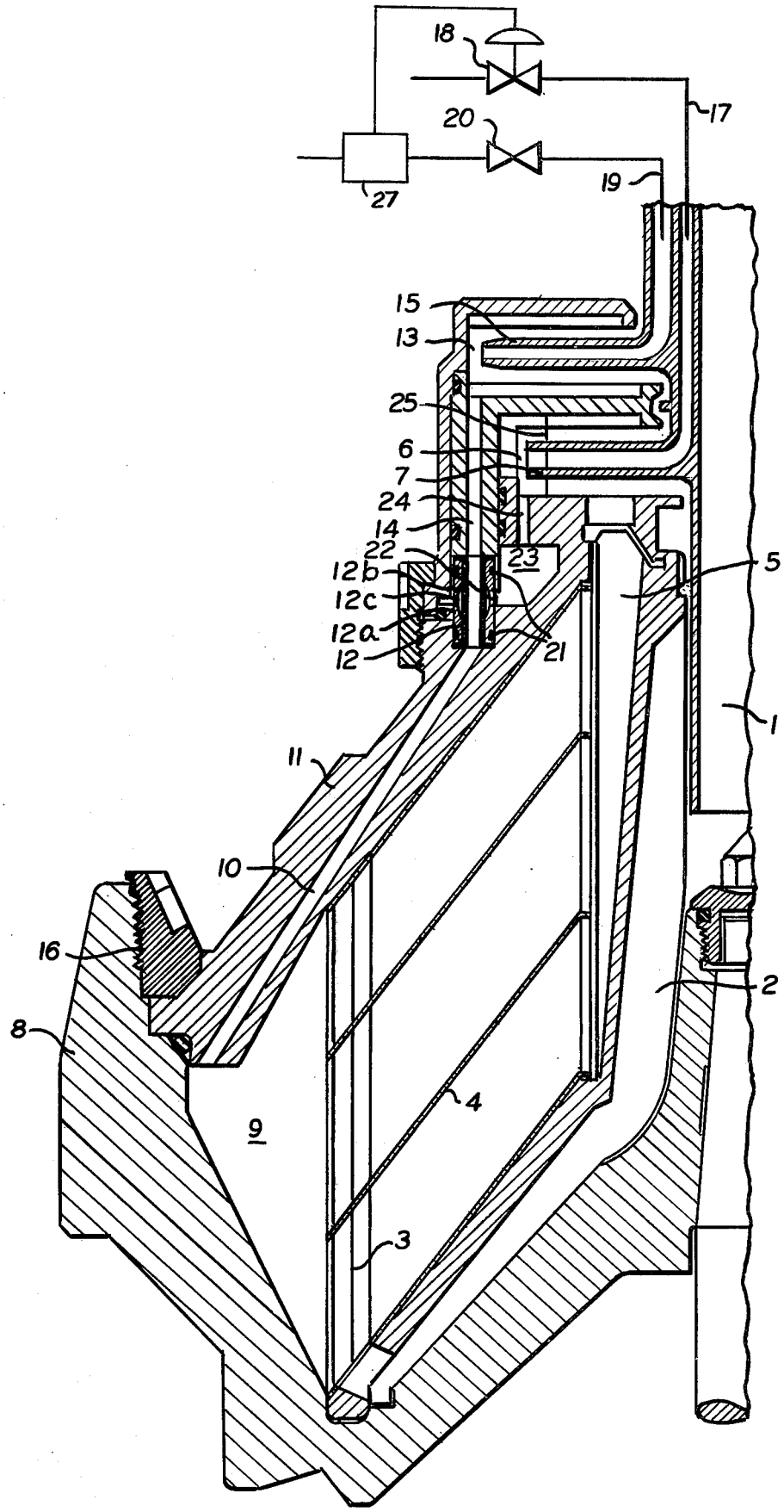
18
17
20
19
27
15
13
25
6
7
24
14
22
23
12b
12c
12a
12
21
5
1
11
10
16
2
8
9
4
3

CONTINUOUSLY OPERATING CENTRIFUGAL SEPARATOR HAVING HYDRAULICALLY OPERATED VALVES

BACKGROUND

The invention relates to a continuously operating centrifugal separator having hydraulically controlled outlet valves for control of the concentration of suspended solids in the concentrated phase produced by the separator.

A centrifugal separator of this type is known, for example, from French Pat. No. 1,554,226, the outlet valves of the passages being operated in accordance with the concentration of the discharged solids. In order to prevent clogging of the outlet valves and the associated danger of the sludging up of the separator or of drum imbalance in the event of an elevated content of solids, the outlet valves have to be enlarged, and in the case of a reduced content of solids they have to be made smaller, so that the desired concentration of the solids will remain constant. In order to avoid to the greatest possible extent the clogging of the outlet passages leading to the valves, the cross section of the passages must be designed for a maximum content of solids.

In the above-cited French Patent, the operation of the outlet valves for the concentrate must be performed through a hydraulic, pneumatic or electromagnetic, controllable closing device disposed in the hollow spindle of the centrifuge, which opens the discharge orifice of the outlet valves as the concentration increases and closes it as the concentration decreases. The regulation of the closing device is performed, for example, in conjunction with a viscosity measuring means provided in the concentrate outlet.

The disadvantage of this closing device is that, on the one hand, its construction is very expensive, and on the other hand the outlet valves can be sealed off only imperfectly, and fine regulation is not possible, since the valves can only open all the way or close all the way. In addition, the closing device must be operated in the outer reach of the paring chamber inside of the solids ring. The disassembly of the valves with the outlet tubes or of the closing device in case of trouble is very complicated since they are disposed in the lower part of the separator and necessitate a complete disassembly of the drum or centrifuge.

THE INVENTION

It is the object of the invention to provide a simpler control of the concentration of solids in centrifugal separators of the above-described type.

The object of the invention has been accomplished by placing the control chamber associated with each valve body, i.e. each controllable closing device, in communication with the clear phase paring chamber by means of passages, and by using a portion of the clear phase as the control fluid.

In a special embodiment, the valve bodies are in the form of resilient, deformable tubular membranes which determine the outlet cross section and whose cross section is variable under the effect of the liquid pressure prevailing in the paring chamber.

The construction of the centrifugal separator in accordance with the invention brings it about that a constant fine regulation of the valve cross section is possible during operation in relation to the produced concentration, the liquid pressure prevailing in the paring chamber, and hence the deformation of the tubular membrane, being regulated by means of a throttling member disposed in the clear phase outlet line. The throttling of the clear phase outlet results in an increasing depth of immersion of the paring disk, a displacement of the inner liquid level towards the drum axis taking place, and thus a greater liquid pressure is exerted on the outer surface of the resilient tubular membrane and reduces the outlet cross section. The regulation of the outlet cross section in conjunction with the depth of immersion of the paring disk is accomplished by means of a throttling member disposed in the clear phase outlet line, this throttling member being operated by a viscosity measuring means provided in the concentrate outlet line.

In the event of a clogged valve, which can also result in turbidity in the clear phase, the depth of immersion of the paring disk is reduced, and therefore the liquid pressure is also reduced, so that the full cross section of the valve is opened up. The turbidity of the clear phase can be sensed by a turbidity meter, for example.

The design of the invention brings it about that no additional, potentially trouble-causing closing device is needed, the outlet valves are disposed in the top of the drum, and the valves can be easily replaced in case of necessity.

An example of the embodiment of the invention is represented in the drawing.

The numeral 1 indicates the inlet tube through which the substance to be concentrated is carried centrally into the distribution chamber 2, then flows through the ascending passages 3 of the plate insert 4, the liquid component of light specific weight flowing inwardly through the plate insert and through the passage 5 into a paring chamber 6 where it is carried out by a paring disk 7.

The separated, specifically heavier solid particles flow in the form of a concentrate through the plate insert radially to the periphery of the drum body 8; they are spun into the sludge chamber 9 and are carried by passages 10 in the drum cover 11 through uniformly spaced outlet valves 12 and passages 14 into the second paring chamber 13, and they are carried out of the drum under pressure by a second paring disk 15. The drum cover 11 and the drum body 8 are held together by a closing ring 16. In the clear phase outlet line 17 there is provided a throttle member 18, and in the concentrate outlet line 19 there is provided a second throttle member 20, as well as a viscosity measuring means for the concentrate, which is not shown. The outlet valve 12 consists of a valve casing **12*a*, a resilient and deformable tubular membrane 12*b* carried sealingly therein, and a control chamber 12*c* surrounding the membrane, the valve casing and the membrane being sealed to the passages 10 and 14 by means of O-rings 21. The outer wall of the tubular membrane 12*b* communicates with the paring chamber 6 through bore 22 in the valve casing, and through the annular passage 23 and passage 24**.

The outlet valve operates in the following manner:

Before the centrifugal separator is charged with liquid, the throttle member 20 in the concentrate outlet line is to be closed or held in a throttled setting until there has built up in paring chamber 6 a liquid pressure which has created a closing pressure through the passage 24, annular chamber 23, bore 22 and control chamber **12*c* on the outer periphery of the tubular membrane 12*b* and has reduced the valve cross section. The separator can also be started without operating the throttle member 20, by first charging the separator with an excess of raw liquid, i.e., with more liquid than can escape through the fully opened valve 12, and a liquid pressure has also built up in the paring chamber 6**.

The liquid pressure in the paring chamber 6 is determined by the depth of immersion of the paring disk 7, the depth of immersion of the paring disk being regulated by the throttle valve 18 disposed in the clear phase outlet line 17 in accordance with the concentration of the discharged solids by means of a viscosity measuring device 27 contained in the conduit 19, which is known. The internal liquid level 25 can be displaced towards the drum axis and the liquid pressure can thus be increased, to such an extent as to permit a complete shutting of the valve 12.

What is claimed is:

1. In a centrifugal separator suitable for the concentration of suspended solids contained in a liquid feed material having a drum for separation of the feed material into a concentrated phase and a clear phase, a passageway in the drum for discharge of concentrated phase, and a hydraulically operated outlet valve in said passageway for control of concentration of the suspended solids in the concentrated phase, said outlet valve having a controllable closing device and a control chamber for hydraulic fluid for the operation of the closing device, the improvement which comprises the separator comprising a paring chamber for discharge of clear phase, and means communicating the paring chamber with said control chamber for tapping off a portion of the clear phase for use as the hydraulic fluid for operation of the closing device.

2. Separator of claim 1, said passageway extending from adjacent the drum periphery toward the drum axis, a paring chamber for the concentrated phase disposed adjacent the drum axis for receiving concentrated phase from said passageway, a paring disk for each of the paring chambers for removal of the respective phases under pressures developed in the paring chambers, said closing device being a resilient deformable tubular membrane disposed for passage of the concentrated phase therethrough and being of variable cross sectional flow area, for determination of the cross sectional flow area of the outlet valve in dependence on the pressure prevailing in the paring chamber for clear phase.

3. Separator according to claim 2, comprising an outlet line in communication with each of the paring discs and a throttling member in each of the outlet lines.

4. Separator according to claim 1, said passageway communicating with an outlet line downstream of the outlet valve, a throttling member in said outlet line, another outlet line in communication with said paring chamber, and a throttling member in said another outlet line.

5. Separator according to claim 1, and means for measuring the concentration of suspended solids in said concentrated phase, and means for controlling the liquid pressure in the paring chamber in dependence on the measurement of suspended solids in the concentrated phase.

* * * * *